US006209792B1

(12) United States Patent
Boorer

(10) Patent No.: US 6,209,792 B1
(45) Date of Patent: Apr. 3, 2001

(54) THERMALLY ACTUATED DIFFUSER

(76) Inventor: Clive Thomas Boorer, 35 Hillingdon Road, Bexleyheath, Kent DA7 6LP (GB)

( * ) Notice: Subject to any disclaimer, the term of this patent is extended or adjusted under 35 U.S.C. 154(b) by 0 days.

(21) Appl. No.: 09/489,564

(22) Filed: Jan. 21, 2000

(51) Int. Cl.[7] ..... F24F 7/00

(52) U.S. Cl. ..... 236/49.5

(58) Field of Search ..... 236/49.5; 454/258

(56) References Cited

U.S. PATENT DOCUMENTS 4,055,954 * 11/1977 Marks et al. ..... 454/258
4,730,771 * 3/1988 Shepherd et al. ..... 236/49.5
5,556,335 * 9/1996 Holyoake ..... 236/49.5

* cited by examiner

*Primary Examiner*—Corrine McDermott
*Assistant Examiner*—Mohammad M Ali

(57) ABSTRACT

A thermally actuated diffuser for controlling room temperature without electrical apparatus. The thermally actuated diffuser includes a housing having a first duct opening and a second duct opening. The second duct opening is diametrically opposed to the first duct opening to produce a linear air path through the housing. The housing has a third exit opening for communicating with a room. A damper blade diverts air flow and is positioned in the interior of the housing. The housing contains a first device and a second device that are both responsive to ambient temperature. The first and second devices each have first and second ends. The first end and the second end are adapted to move away from each other when the device is warmed and to move toward each other when the device is cooled. The first device is positioned in the interior of the housing adjacent to the air path. The second device is positioned in the housing adjacent to the third exit opening. The devices are mounted on opposite sides of the damper blade. A bracket assembly couples the first end of the first device to the damper blade. A mounting assembly mounts the first device to the second device. A hinge couples the second device to the mounting assembly. The damper blade has openings therein adapted to allow the mounting assembly to be movable relative to the pivot shaft, wherein the mounting assembly is movable between a warmed position and a cooled position of the first device.

16 Claims, 11 Drawing Sheets

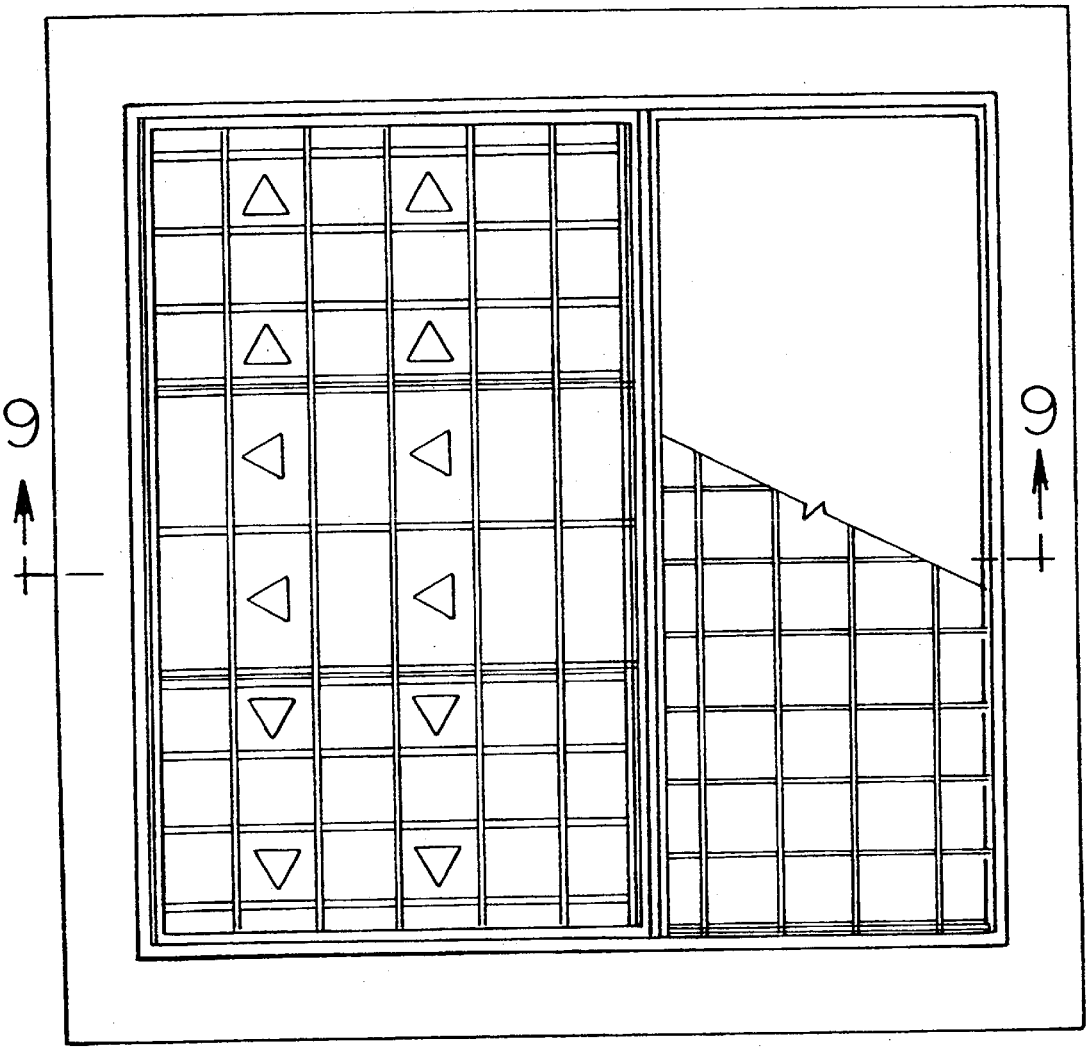
FIG. 3
FIG. 9
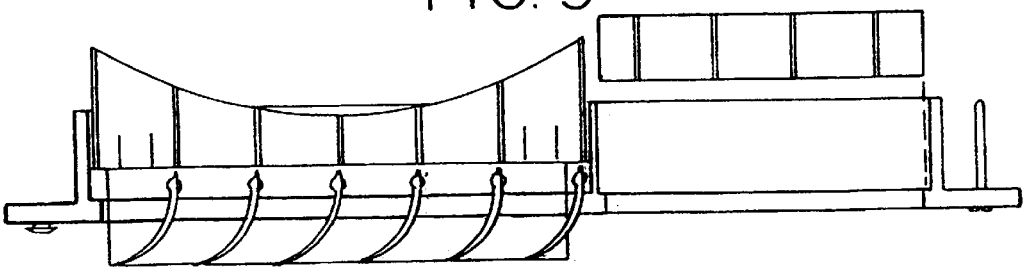

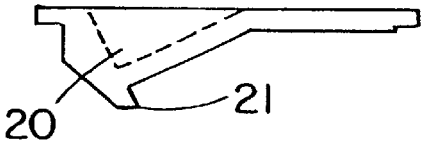
FIG. 5
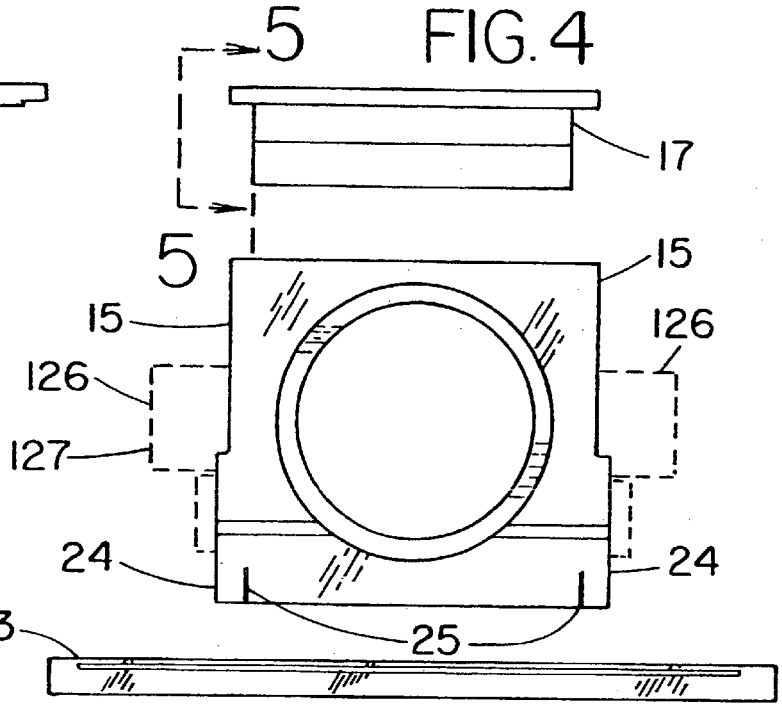
FIG. 4
FIG. 6
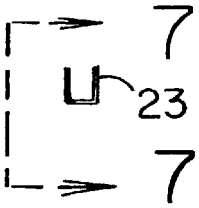
FIG. 7
FIG. 8
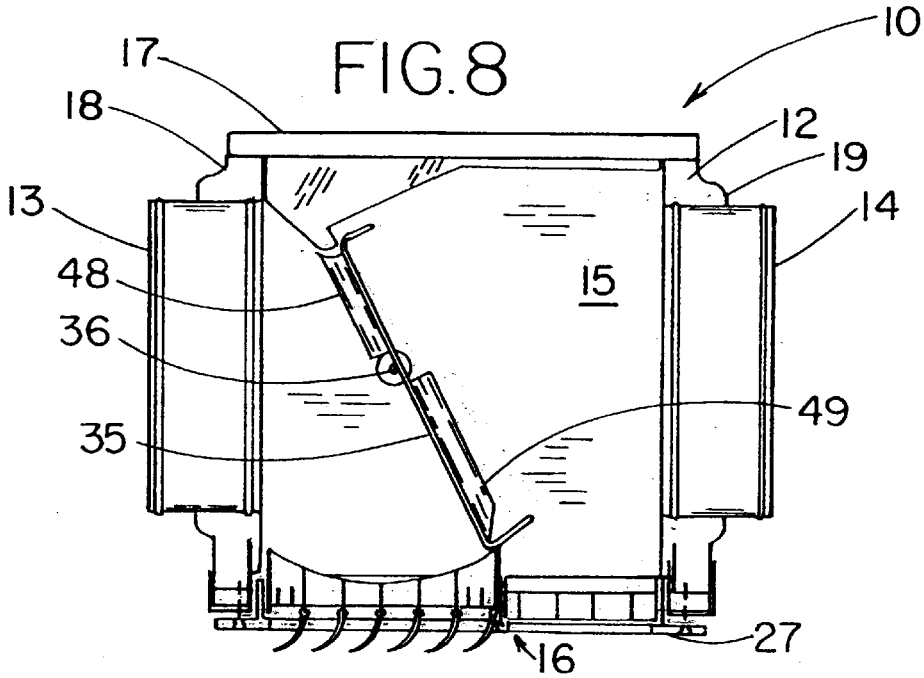

FIG. 12
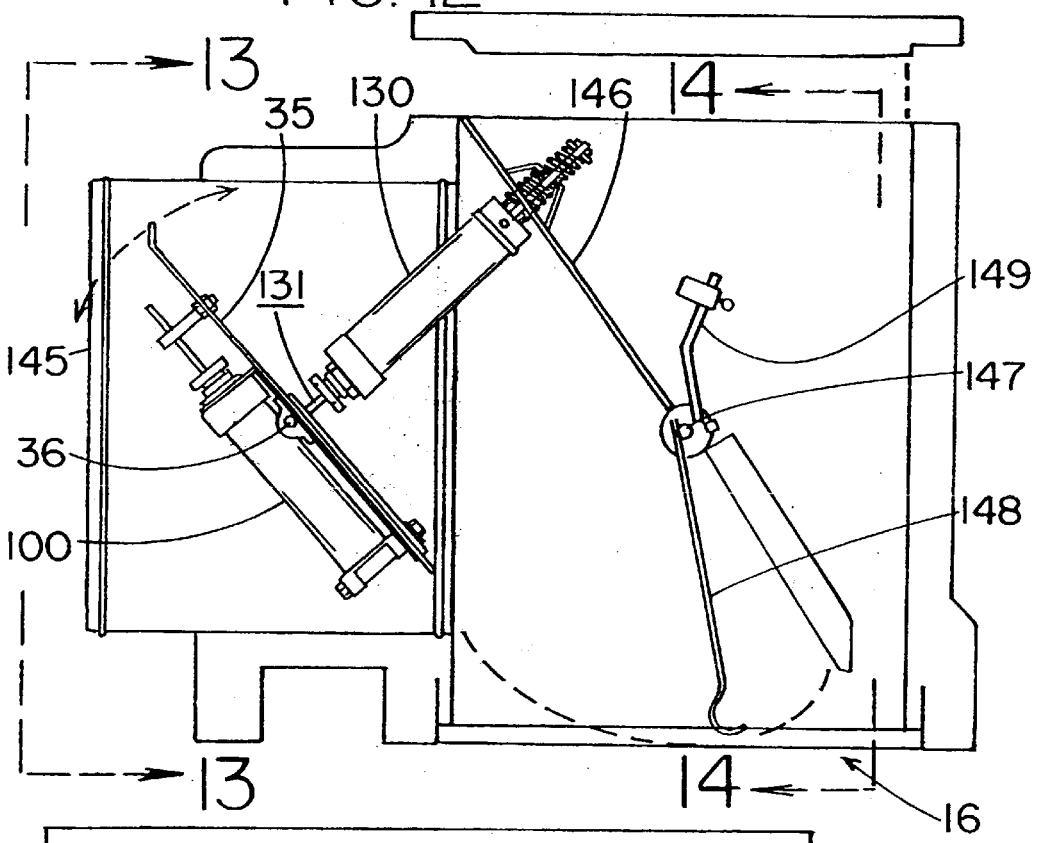
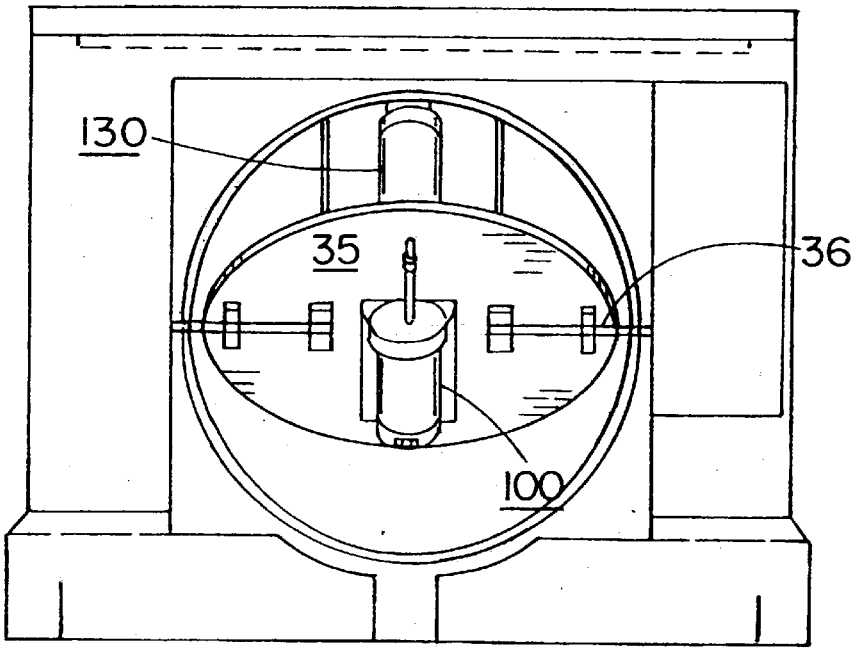
FIG. 13

THERMALLY ACTUATED DIFFUSER

BACKGROUND OF THE INVENTION

1. Field of the Invention

The present invention relates to air diffusers and more particularly pertains to a new thermally actuated diffuser for diffusing air and controlling room temperature without electrical apparatus.

2. Description of the Prior Art

The use of air diffusers is known in the prior art. More specifically, air diffusers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,231,513; U.S. Pat. No. 4,509,678; U.S. Pat. No. 4,711,394; U.S. Pat. No. 4,570,850; U.S. Pat. Des. No. 331,102; and U.S. Pat. No. 2,257,007.

While these devices fulfill their respective, particular objectives and requirements, the aforementioned patents do not disclose a new thermally actuated diffuser. The inventive device includes a housing having a first duct opening and a second duct opening. The second duct opening is diametrically opposed to the first duct opening to produce a substantially linear air path through an interior of the housing. The housing has a third exit opening wherein the third exit opening lies in a plane orientated substantially perpendicular to the first duct opening and the second duct opening. A damper blade for diverting air flow from the air path is positioned in the interior of the housing. The housing contains a first device and a second device which are both responsive to ambient temperature. The first and second devices each have first and second ends. The first end and the second end are adapted to move away from each other when the device is warmed and to move toward each other when the device is cooled. The first device is positioned in the interior of the housing adjacent to the air path so as to be struck by air flowing along the air path. The second device is positioned in the housing adjacent to the third exit opening so as to be surrounded by air entering the interior of the housing through the third exit opening. The first device is on one side of the damper blade and the second device is on the opposite side of the damper blade. A bracket assembly couples the first end of the first device to the first side of the damper blade such that a longitudinal axis of the first device is oriented substantially perpendicular to the air flow. A mounting assembly mounts the first device to the second device. The second device has a longitudinal axis oriented substantially perpendicular to the longitudinal axis of the first device. A hinge couples the second device to the mounting assembly. The damper blade has openings therein adapted to allow the mounting assembly to be movable relative to the pivot shaft, wherein the mounting assembly is movable between a warmed position and a cooled position of the first device.

In these respects, the thermally actuated diffuser according to the present invention substantially departs from the conventional concepts and designs of the prior art, and in so doing provides an apparatus primarily developed for the purpose of diffusing air and room temperature control without electrical apparatus.

SUMMARY OF THE INVENTION

In view of the foregoing disadvantages inherent in the known types of air diffusers now present in the prior art, the present invention provides a new thermally actuated diffuser construction wherein the same can be utilized for diffusing air and controlling room temperature without electrical apparatus.

The general purpose of the present invention, which will be described subsequently in greater detail, is to provide a new thermally actuated diffuser apparatus and method which has many of the advantages of the air diffusers mentioned heretofore and many novel features that result in a new thermally actuated diffuser which is not anticipated, rendered obvious, suggested, or even implied by any of the prior art air diffusers, either alone or in any combination thereof.

To attain this, the present invention generally comprises a housing having a first duct opening and a second duct opening. These openings are to be connected to a duct system that will supply a quantity of conditioned air to the first duct opening and remove a substantially similar quantity of air from the second duct opening. The second duct opening is diametrically opposed to the first duct opening to produce a substantially linear air path through an interior of the housing. The housing has a third exit opening wherein the third exit opening lies in a plane orientated substantially perpendicular to the first duct opening and the second duct opening. A damper blade, for diverting air flow from the air path, is positioned in the interior of the housing. The housing contains a first device and a second device which are both responsive to ambient temperature. The first and second devices each have first and second ends. The first end and the second end are adapted to move away from each other when the device is warmed and to move toward each other when the device is cooled. The first device is positioned in the interior of the housing adjacent to the air path so as to be struck by air flowing along the air path. The second device is positioned in the housing adjacent to the third exit opening so as to be surrounded by air entering the interior of the housing through the third exit opening. The first device is on one side of the damper blade and the second device is on the opposite side of the damper blade. A bracket assembly couples the first end of the first device to the first side of the damper blade such that a longitudinal axis of the first device is oriented substantially perpendicular to the air flow. A mounting assembly mounts the first device to the second device. The second device has a longitudinal axis oriented substantially perpendicular to the longitudinal axis of the first device. A hinge couples the second device to the mounting assembly. The damper blade has openings therein adapted to allow the mounting assembly to be movable relative to the pivot shaft, wherein the mounting assembly is movable between a warmed position and a cooled position of the first device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new thermally actuated diffuser apparatus and method which has many of the advantages of the air diffusers mentioned heretofore and many novel features that result in a new thermally actuated diffuser which is not anticipated, rendered obvious, suggested, or even implied by any of the prior art air diffusers, either alone or in any combination thereof.

It is another object of the present invention to provide a new thermally actuated diffuser which may be easily and efficiently manufactured, marketed, and installed. The installation of the diffuser and housing is quicker and more airtight compared to existing models.

It is a further object of the present invention to provide a new thermally actuated diffuser which is of a durable and reliable construction.

An even further object of the present invention is to provide a new thermally actuated diffuser which is susceptible of a low cost of manufacture with regard to both materials and labor, and which accordingly is then susceptible of low prices of sale to the consuming public, thereby making such thermally actuated diffuser economically available to the buying public.

Still yet another object of the present invention is to provide a new thermally actuated diffuser which provides in the apparatuses and methods of the prior art some of the advantages thereof, while simultaneously overcoming some of the disadvantages normally associated therewith.

Still another object of the present invention is to provide a new thermally actuated diffuser for diffusing air and room temperature control without electrical apparatus.

Yet another object of the present invention is to provide a new thermally actuated diffuser which includes a housing having a first duct opening and a second duct opening. The second duct opening is diametrically opposed to the first duct opening to produce a substantially linear air path through an interior of the housing. The housing has a third exit opening wherein the third exit opening lies in a plane orientated substantially perpendicular to the first duct opening and the second duct opening. A damper blade for diverting air flow from the air path is positioned in the interior of the housing. The housing contains a first device and a second device which are both responsive to ambient temperature. The first and second devices each have first and second ends. The first end and the second end are adapted to move away from each other when the device is warmed and to move toward each other when the device is cooled. The first device is positioned in the interior of the housing adjacent to the air path so as to be struck by air flowing along the air path. The second device is positioned in the housing adjacent to the third exit opening so as to be surrounded by air entering the interior of the housing through the third exit opening. The first device is on one side of the damper blade and the second device is on the opposite side of the damper blade. A bracket assembly couples the first end of the first device to the first side of the damper blade such that a longitudinal axis of the first device is oriented substantially perpendicular to the air flow. A mounting assembly mounts the first device to the second device. The second device has a longitudinal axis oriented substantially perpendicular to the longitudinal axis of the first device. A hinge couples the second device to the mounting assembly. The damper blade has openings therein adapted to allow the mounting assembly to be movable relative to the pivot shaft, wherein the mounting assembly is movable between a warmed position and a cooled position of the first device.

Still yet another object of the present invention is to provide a new thermally actuated diffuser that can be placed in existing duct work without a need for electrical wiring. This serves the valuable purpose of having the ability of installing additional temperature control equipment in older buildings where there is a need to retain structural integrity.

Even still another object of the present invention is to provide a new thermally actuated diffuser that can be modified for use of electricity if desired.

It is further object of the present invention to give near constant air throw from the grill face at variable supply volumes and temperatures by positioning the top of the damper blade at the slanting face of the housing top, to give constant supply plenum pressure, and the bottom of the damper blade over the supply grill blade follower to adjust the free area aperture of the grill to suit the air volume supplied to the room.

Still another object of the present invention is site adaptation of the supply grill which can be altered to suit changing office layouts. The blades of the grill can be changed to direct flow in differing patterns.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic top view of a second embodiment of a grill for the present invention.

FIG. 4 is a schematic front view of the housing of the present invention.

FIG. 5 is a schematic side view of the lid taken along the line 5—5 of the present invention.

FIG. 6 is a schematic side view of the box supports of the present invention.

FIG. 7 is a schematic frontal view taken along the line 6—6 of the box supports of the present invention.

FIG. 8 is a schematic side view of the housing of the present invention.

FIG. 9 is a schematic side view of the second embodiment of the grill of the present invention.

FIG. 12 is a schematic plan view of the second embodiment of the present invention.

FIG. 13 is a schematic frontal view taken along line 13—13 of the second embodiment of the present invention.

DESCRIPTION OF THE PREFERRED EMBODIMENT

Figure 1:
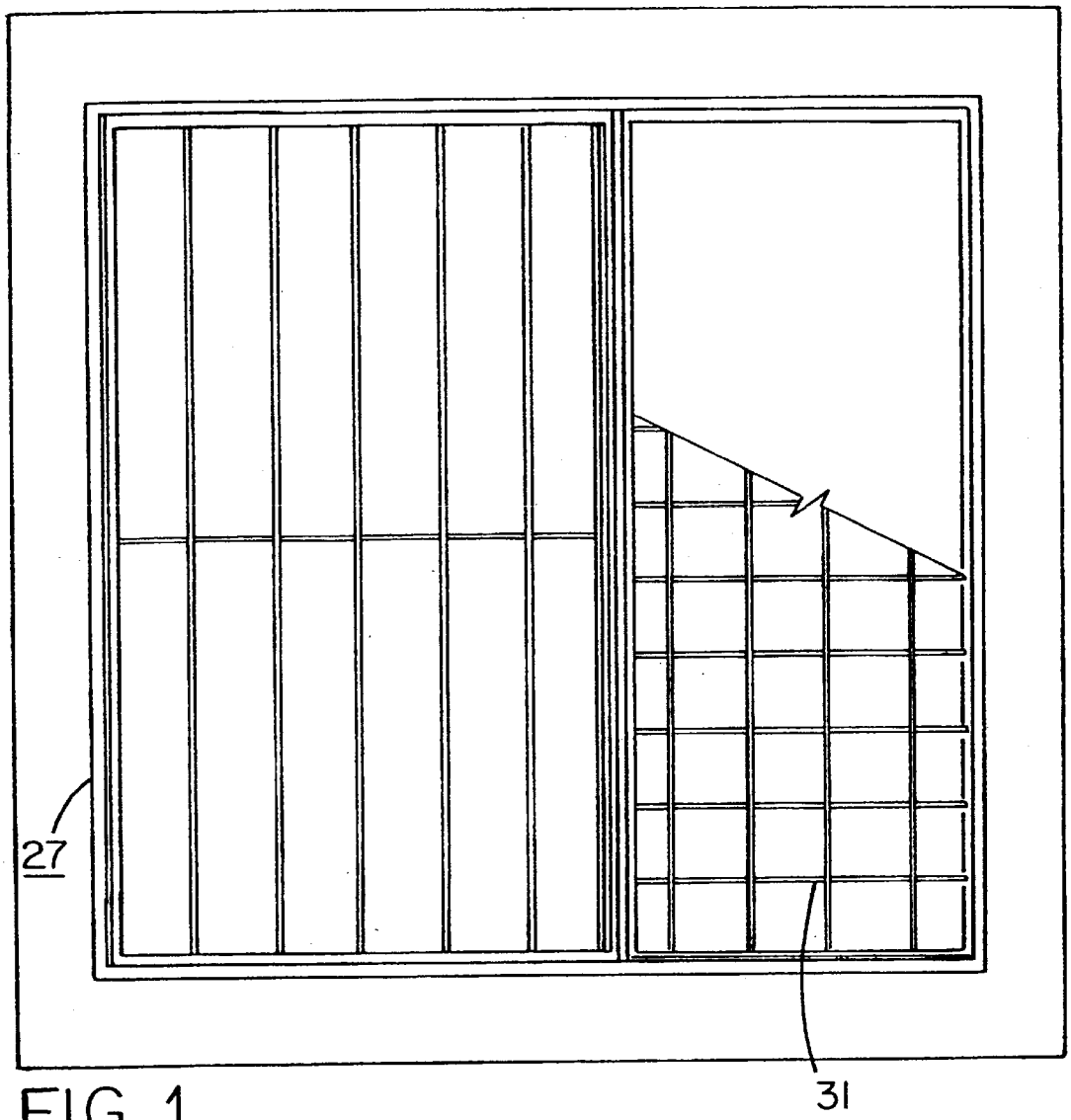
FIG. 1 is a schematic front view of a grill for the present invention.
Figure 2:
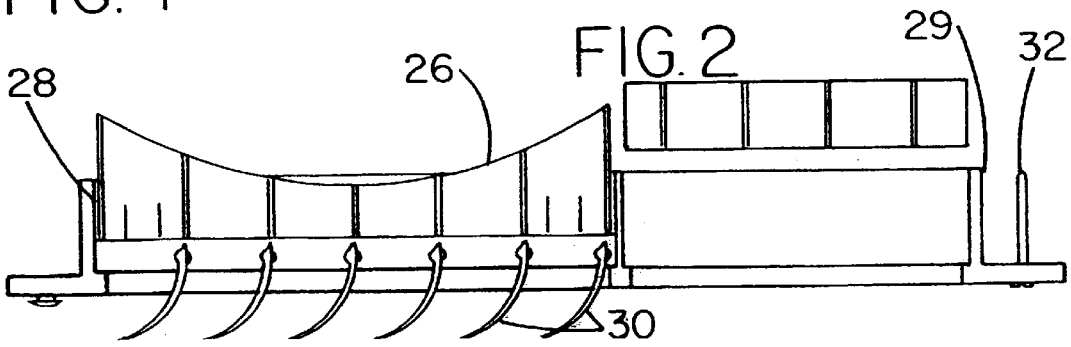
FIG. 2 is a schematic side view of a grill of the present invention.

With reference now to the drawings, and in particular to FIGS. 1 through 20 thereof, a new thermally actuated diffuser embodying the principles and concepts of the present invention and generally designated by the reference numeral 10 will be described.

As best illustrated in FIGS. 1 through 20, the thermally actuated diffuser 10 generally comprises a housing 12 having a first duct opening 13 for communicating with a first duct and a second duct opening 14 for communicating with a second duct. The second duct opening is diametrically opposed to the first duct opening to produce a substantially linear air path through the housing from the first duct opening to the second duct opening. The first and second ducts each lie in a plane substantially parallel to the plane of the other duct opening. The housing has opposing walls 15 positioned on either side of the air path. The housing has a third exit opening 16 for communicating with a room. The third exit opening lies in a plane orientated substantially perpendicular to the first duct opening 13 and the second duct opening 14. The housing has a rebate 47 therein for facilitating an airtight fit between the housing and grill 27.

A lid 17 on the housing has a proximal side 18 and a distal side 19, wherein the proximal side 18 of the lid is positioned adjacent to an edge of the first duct opening 13. The lid is preferably removable. The proximal side has a protuberance 20 extending toward the third exit opening. The protuberance is generally triangular in shape, and has an apex with an edge 21 extending therefrom. The protuberance helps create an airtight seal in the housing by allowing the damper blade 35 to run adjacent to it and thus prevent air from escaping out the second duct opening over the damper blade. Ideally, after manufacture, the lid is fixedly mounted to the housing to prevent the lid from falling away from the housing.

Two box supports 23 are used for supporting the housing within a wall. Ideally, the box supports can be places on any opposite sides of the housing. Each of the box supports comprises an elongate U-shaped channel spring shaft to grip the housing 12. The housing 12 has opposite edges 24 on a side of the housing having the third exit opening. Each of the box supports is adapted to mount on one of the edges of the housing. The edges of the housing have two slots 25 therein for receiving the box supports The grip position of the support 23 on the housing is adapted to self-adjust to a position dependent on the wall thickness between the back of a grill 27 flange and the housing 12. Such adjustment occurs as the edge of the grill 27 flange pulls onto the rebate 47 in the housing 12 and forms an airtight seal when tightened.

The grill 27 is utilized for directing airflow inwardly and outwardly of the third exit opening. The grill has dimensions adapted to fit across the side of the box that has the third exit opening 16. The grill has a proximal side 28 and a distal side 29 and is oriented such that the proximal side of the grill is adjacent to an edge of the first duct opening 13 in the housing. The proximal side of the grill has rotatable eyelash vents 30 mounted thereon. The eyelash vents are oriented substantially perpendicular to the air path. And are preferably rotatable to direct outgoing airflow. The distal side of the grill has rectangular vents 31 therein. The grill is fastened to the box supports by a fastener means 32. Ideally, the grill has a blade follower 26. The blade follower has a concave surface directed toward the inside of the housing. The blade follower allows a damper blade 35 to run across it and create a more air tight seal to prevent air from leaking underneath the blade 35 as air travels from the first duct opening 13 to the second duct opening 14. Screws travel through the wall and then the U-shaped box supports in order to create an air-tight fit against the wall.

A damper blade 35 diverts air flow from the air path. The damper blade is positioned in the interior of the housing 12, and is positioned generally parallel to the first duct opening 13 in the housing. The damper blade has a first and second side, wherein the first side of the damper blade generally faces the first duct opening 13. The damper blade is pivotally mounted in the interior of the housing for pivoting between a first position wherein substantially all of the air flow along the air path is diverted through the third exit opening 16 and a second position wherein the air flow along the air path is permitted to move along the air path without diversion of a significant amount of air flow through the third exit opening. Preferably, the damper blade has an upper side seal 48, and a lower side seal 49. The seals 48,49 extend from the blade and run against the sides of the housing to prevent air from traveling around the sides of the damper blade and out through the second duct exit.

A pivot shaft 36 is mounted to the damper blade for permitting rotation of the damper blade. The pivot shaft is mounted in the housing, and has opposite mounting ends. Each of the mounting ends is mounted to one of the opposing walls 15 of the housing. The mounting ends are mounted in pivot shaft bearings 33. The pivot shaft is oriented substantially perpendicular to the air path between the first duct opening 13 and the second duct opening 14. The pivot shaft is comprised of two separate elongate portions 37, 38 with an open expanse therebetween. Each elongate portion has an interior end 38 spaced from an interior end of the other elongate portion. The interior 38 end of each elongate portion is coupled to the damper blade 35. The pivot shaft 36 is rotatable and adapted to allow the damper blade to rotate in the air path.

Two hole caps 39 are used for mounting a yolk 41. Each of the hole caps is mounted on one of the spaced interior ends of the pivot shaft. Hole caps form seals over holes in the damper blade which will are necessary for reasons which will become readily apparent. The yolk has two elongate members 141, wherein each of the elongate members is coupled to one of the spaced interior ends of the pivot shaft in hole caps such that the hole caps cover the ends of the elongate members of the yolk as they couple with the pivot shaft. The elongate members 141 extending outwardly from the hole caps parallel to each other in the direction of the second duct opening 14 of the housing 12.

A first device 100 wherein the first device is responsive to the ambient temperature around the first device.

A second device 130 wherein the second device is responsive to the ambient temperature around the second device.

The first and second devices are generally elongate and each of the devices has a first end 101 and a second end 102, wherein the first end and the second end are adapted to move away from each other when the device is warmed. The first end and the second end are adapted to move toward each other when the device is cooled. Wherein, the first and second ends are relatively extended away from each other in a warmed position and the first and second ends are relatively retracted inwardly toward each other in a cooled position. Each of the first ends 101 includes a piston shaft 103 and each of the second ends includes a cylinder 104 which has the piston shaft slidably received therein. The first device 100 is positioned in the interior of the housing adjacent to the air path so as to be surrounded by air flowing along the air path.

A bracket assembly 50 couples the first end 103 of the first device to the damper blade 35. A first portion 51 of the bracket assembly is coupled to the piston shaft of the first device. A second portion 52 of the bracket is coupled to the damper blade 35 such that a longitudinal axis of the first device is substantially perpendicular to the air flow. The first device is positioned between the spaced ends 38 of the pivot shaft.

A mounting assembly mounts the first device 100 to the second device 130. The first and the second devices are located on opposite sides of the damper blade 35. The second device 130 has a longitudinal axis oriented substantially perpendicular to the longitudinal axis of the first device 100. The second device 130 is positioned between the distal side of the lid 19 and the distal side of the grill 32 so as to be surrounded by air entering the interior of the housing through the third exit opening.

The mounting assembly 60 is comprised of a first plate 61 adjacent to the first device 100. The first plate is longer than the cylinder 104 of the first device and has an L-shape with a long end 62 and a short end 63. The short end of the L-shaped plate is affixed to the end of the first device where the piston shaft is located 103, and the long end of the first L-shaped plate is parallel to the first device. The first plate is located between the first device and a first side of the damper blade.

A second plate 64 is located between the second device 130 and a second side of the damper blade. The second plate is oriented substantially parallel to the first plate.

A first coupling means 65 couples the first plate to the second plate. Preferably, the first coupling means is a bolt which is affixed to the end of the first device which extends through the first and second plates. The first coupling means is mounted to the second end of the first device. The first coupling means is orientated perpendicular to the long portion of the first plate 62. The first coupling means extends through a bore in the first plate, a first spacer 71 mounted in a slot in damper blade 35, and a bore in the second plate.

A second coupling means 66 with a second spacer couples to the first plate to the second plate and is located substantially at the intersection of a longitudinal line of the second device and the second plate. Preferably, the second coupling means is a rectangular plate 69 with a bolt 67 extending through each corner thereof. A nut 68 secures each of the bolts.

A hinge 70 couples the second device to the mounting assembly. The hinge is substantially centered on the second coupling means 66 and is fixedly coupled to the first plate between the first plate and the first device. The hinge is coupled to the piston shaft of the second device 131, wherein the piston shaft of the second device extends through a bore in the first plate, the damper blade 35 and a bore in the second plate to couple to the hinge.

The damper blade has openings therein, not shown, adapted to allow the first plate 61 to be connected to the second plate 64 such that the mounting assembly is movable relative to the pivot shaft. The mounting assembly is movable between a warmed position and a cooled position of the first device.

The cylinder 104 of the first and second devices has a substantially hollow interior. The hollow interior is defined by an inner wall. A plug 105 is adjacent to the second end of the device. The plug has bore 106 therethrough. A sealing washer 107 is used to prevent the wax from moving against the plug. The sealing washer is adjacent to the plug. A wax fill cavity portion 108 is used for holding the wax. The cavity defined by the inner wall of the cylinder, the plug and an inner shuttle nut 113. A return spring 110 has a first end adjacent to and biased against the spring base 109. A piston shaft 103 extends away from the spring base through and out of the interior of the cylinder 104. A shaft clip 111 retains the return spring 110, the spring base 109 and the piston shaft 103. A stop washer 112 is adjacent to and biased against a second end of the return spring. An inner shuttle nut 113 rests against the stop washer 112 and forms the top portion of the wax cavity. A shaft 'O' ring 114 is adjacent to the inner shuttle. A shuttle 'O' ring 115 is adjacent to the shaft 'O' ring. A shuttle 116 is adjacent to the shuttle 'O' ring.

An over-pressure spring 117 is adjacent to and extends away from the shuttle 116. A compressor bottom 118 and a compressor top 119 are on either end of the over-pressure spring 117. A cap 120 is placed adjacent to the compressor top 119 and is outside of the cylinder of the device. A pressure adjuster means 121 for adjusting movement of the shuttle 116 is affixed to the cap with a lock nut with the piston shaft 103 extending through a bore in the adjuster means and the cap 120. The pressure adjuster means has a shaft stroke adjuster means 122 therein which is biased against a piston stroke stop 123 on the piston.

The second device is generally identical to the first device. The second device further uses its plug 135 for support.

A pin 136 is mounted in the bore in the plug and extends outwardly away from the plug. The pin forms a spring and bearing mount and has a first end 137 and a second end 138. A first relief spring 139 is mounted on the spring mount. The first relief spring 139 rests against the plug 135. A support bearing 140 is located at an apex of the first relief spring 139. The support bearing is connected to the two elongate members 141 from the yolk 41. The elongate members 141 extending horizontally and diametrically away from each other and from the support bearing. The elongate members bend to become parallel to each other to define the piston yolk 41. The piston yolk 41 is coupled to and supported by the cowl 40. The cowl 40 supports the second device. The cowl has a first side portion 42, a second side portion 43, and a top portion 44. The first side portion 42 is coupled to one of the elongate members 141 of the yolk 41, and the second 43 side portion is coupled to the other of the elongate members of the yolk. A second relief spring 142 is mounted on the spring mount. The second relief spring 142 has a first end adjacent to the piston yoke which is connected to the support bearing 140. A stop washer 143 is affixed by a nut 144 to the second end of the spring mount. The pin 136 is coupled to the yolk 41 by the support bearing 140. The cowl 40 extends toward the second duct opening 14 and rests inside that opening.

A quantity of wax is located in the wax fill cavities 108 of each of the first and second devices. The wax expands when subjected to additional thermal energy and contracts when thermal energy is removed. Any over expansion of the wax not required in the movement of the piston shaft 103 is absorbed by the over pressure spring 117. The wax is preferably heat treated paraffin wax made by Bayliss Precision Components Ltd., Lydander Works, Blenheim Road, Airfield Induatial Estate, Ashbourne, Derbyshire, DE6 1HA England.

In use, the air diffuser is mounted into a wall or a ceiling within an air duct passageway. Two box supports 23 are used for supporting the housing within a wall or ceiling. The supports fit in slits or slots 25 on either edge 24 of the third opening 16. The edges of the housing have two slots 25 therein for receiving the box supports. The box supports can be fastened into the wall or ceiling by any number of fastening means known in the art, though screws are preferred.

The grill 27 is utilized for directing airflow inwardly and outwardly of the third exit opening. The grill 27 is attached to the housing to cover the third exit opening. The grill is attached or fastened to the housing by a fastener means 32. Preferably, the fastener means is a screw. The proximal side of the grill 28 has rotatable eyelash vents 30 mounted thereon. The eyelash vents are rotatable so that as air is spilled into the room, the user may change the direction of air flow. Eyelash vents are preferred over straight vents as cold air coming in through a ceiling would tend to fall directly downward if not directed into a circulation pattern. Another embodiment of eyelash vents, as best depicted in FIG. 9, show vents pointing in more than one direction for increased air diffusion. The distal side 29 of the grill has rectangular vents 31 therein. These vents allow air to enter the housing from the room and surround the second device.

Air comes through the first duct and through the first duct opening 13. Depending on how the damper blade 35 is tilted, the air is either allowed to enter the room through the eyelash vents, or it is bypasses the eyelash vents and continues through the housing and out the second duct opening 14 or an intermediate position to maintain room temperature. The first device 100 is on the side of the damper blade facing the first duct opening 13 and is surrounded by air as it enters the housing through that duct. The second device, 130 is on the side of the damper blade 35 facing the second duct opening 14 and is surrounded by air which enters the housing through the third exit opening and leaving the housing by the second duct opening.

Both devices are comprised, primarily, of a cylinder 104 and a piston shaft 103. The cylinder contains a wax filled cavity 108 which contains thermally sensitive wax. The wax expands as thermal energy is absorbed and contracts as thermal energy is released. The piston shaft 103 extends outward from the cylinder when the wax expands and the piston shaft retracts into the cylinder 104 when the wax contracts under pressure of the return spring 110. The wax is contained in a compartment surrounded by the inner walls of the device 100, a plug 105 and an inner shuttle nut 113.

A bracket assembly 50 couples the piston shaft of the first device to the damper blade 35. The first device is positioned between the spaced ends 38 of the pivot shaft 36. Thus, when the piston 103 of the first device retracts or extends, the cylinder 104 moves relative to the pivot shaft 36 while the pivot shaft remains stationary.

A mounting assembly mounts the first device 100 to the second device 130 such that the cylinder of the first device directs the location of the hinge 70 and piston shaft of the second device 131 relative to the pivot shaft 36. The mounting assembly is comprised of a first plate 61 and a second plate 64. The plates are connected in two areas. The first area is located near the plug 105 of the first device. The second area is near a longitudinal midpoint of the cylinder of the first device. The first area binds the two plates, while the second area binds the plates with four bolts 67 and nuts 68 while at the same time created a place for a hinge 70 to which the piston shaft 131 of the second device 130 will couple. The first and second spacers stop plates 61 and 64 from gripping the damper blade 35.

The damper blade has a rectangular opening between the two plates. This opening allows the plates 62 and 64 to move unrestricted within the plane of the damper blade 35. Thus the brackets are movable relative to the pivot shaft 36 which allows the piston shaft 131 of the first device to move relative to the pivot shaft 36.

Figure 10:
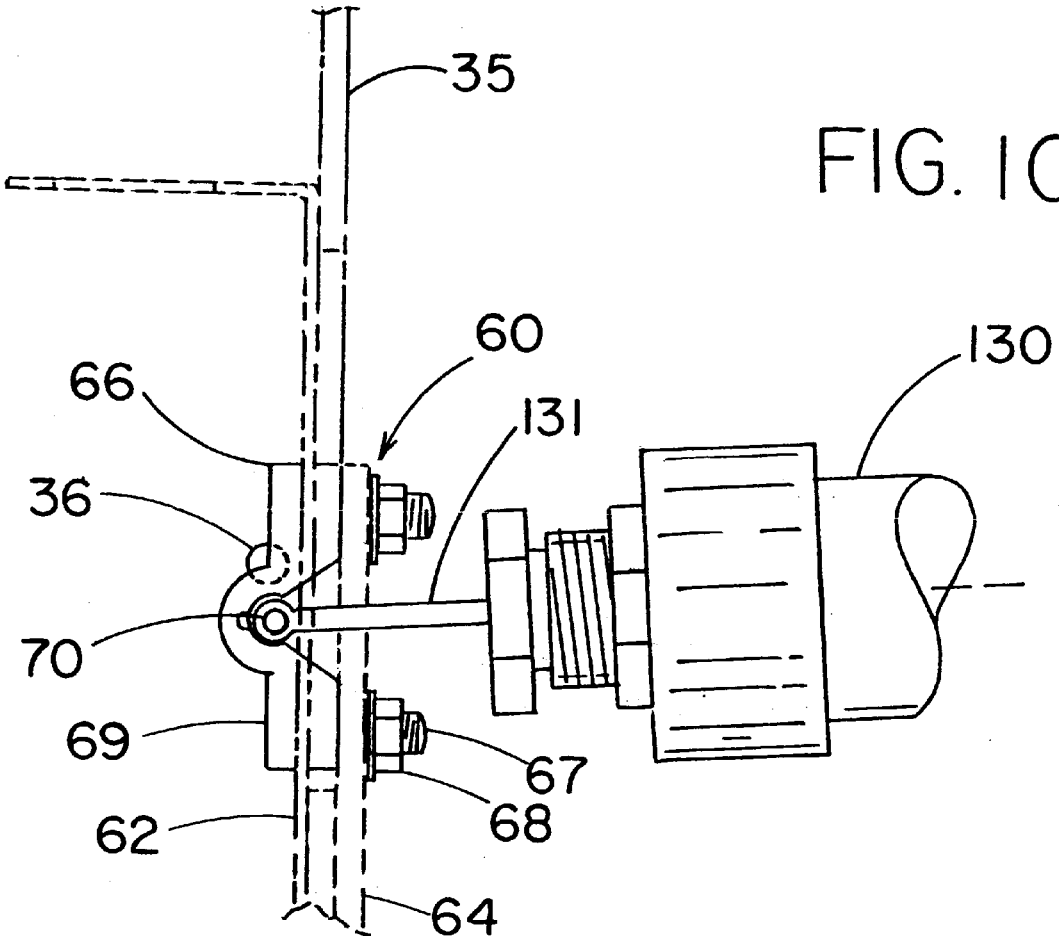
FIG. 10 is a schematic exploded view of the mounting assembly of the present invention.
Figure 11:
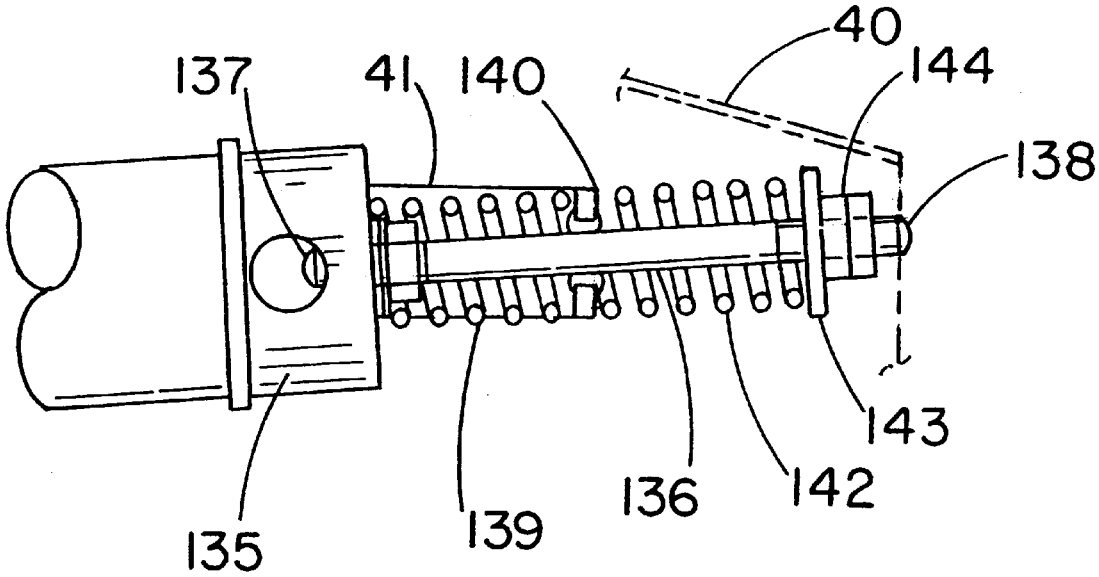
FIG. 11 is a schematic exploded view of the second device of the present invention.
Figure 14:
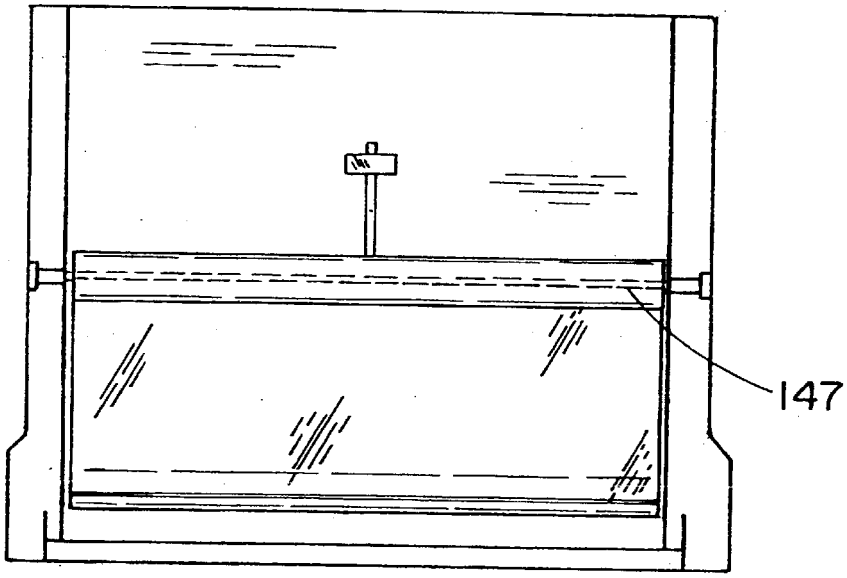
FIG. 14 is a schematic cross-sectional view taken along line 14—14 of the second embodiment of the present invention.
Figure 16:
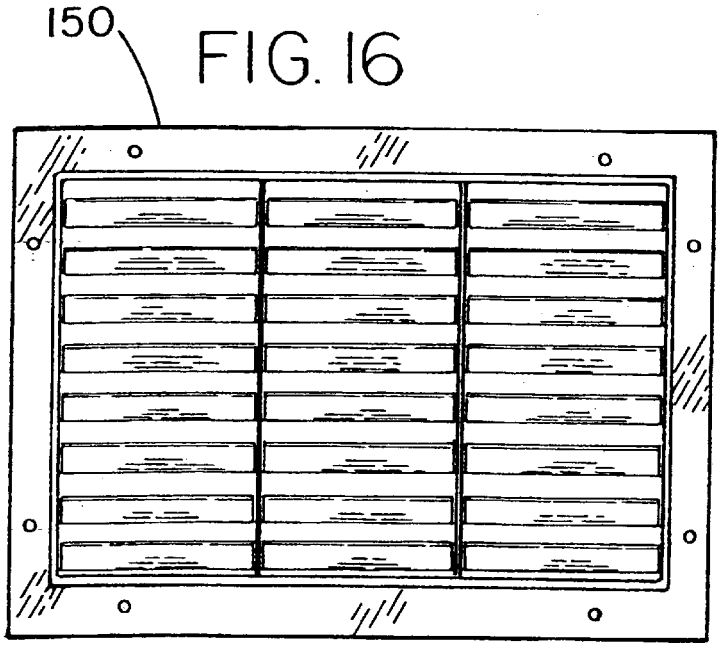
FIG. 16 is a schematic top view taken along line 16—16 of the grill for the second embodiment of the present invention.
Figure 15:
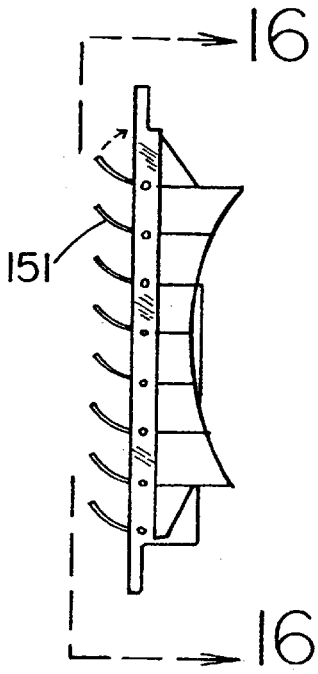
FIG. 15 is a schematic side view of the grill for the second embodiment of the present invention.
Figure 17:
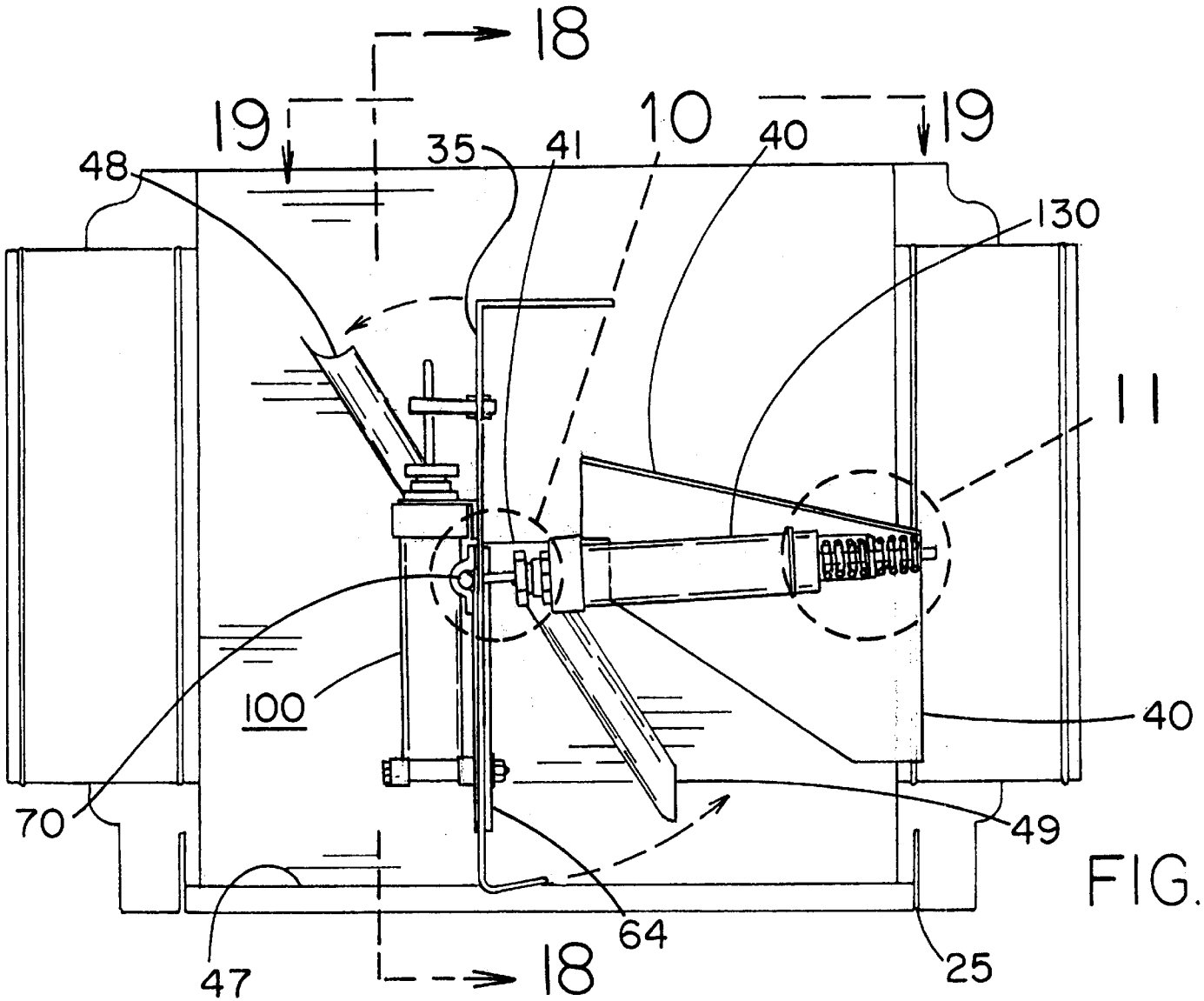
FIG. 17 is a schematic sectional side view taken along line 17—17 of the present invention.
Figure 18:
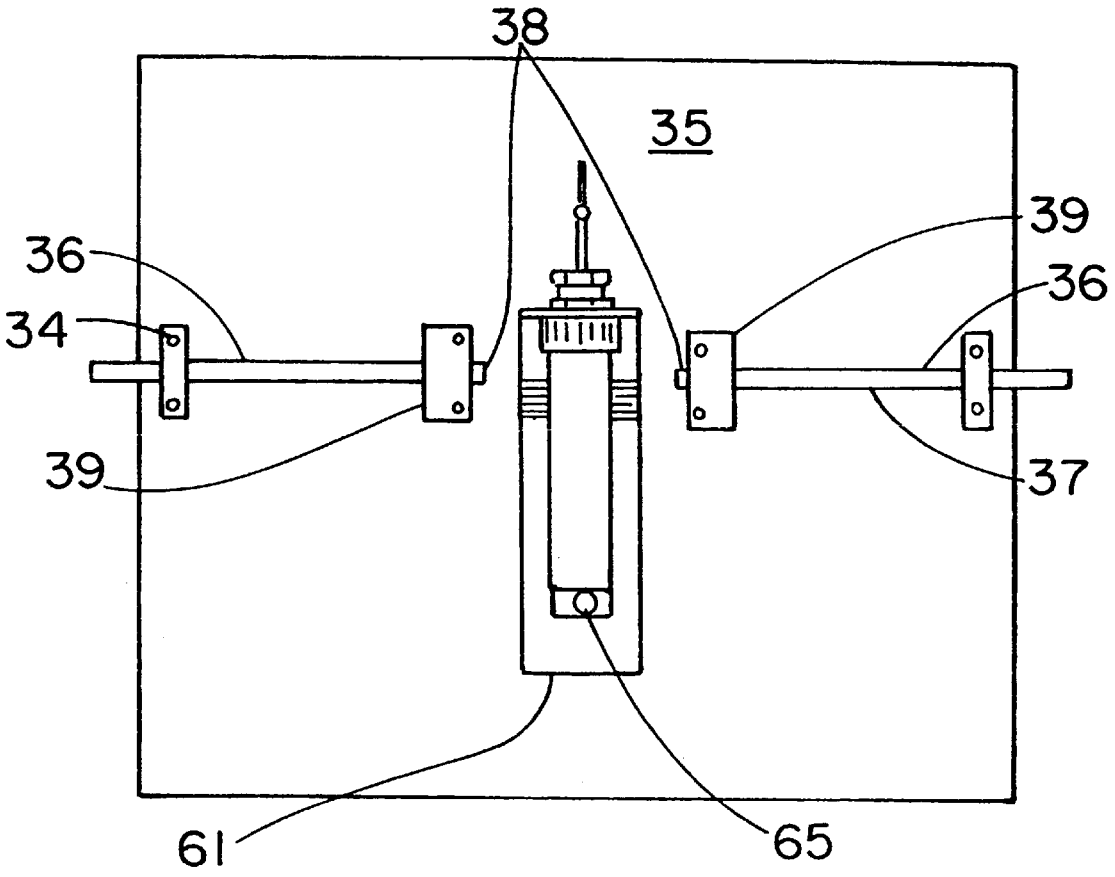
FIG. 18 is a schematic frontal view taken along line 18—18 of the present invention.
Figure 19:
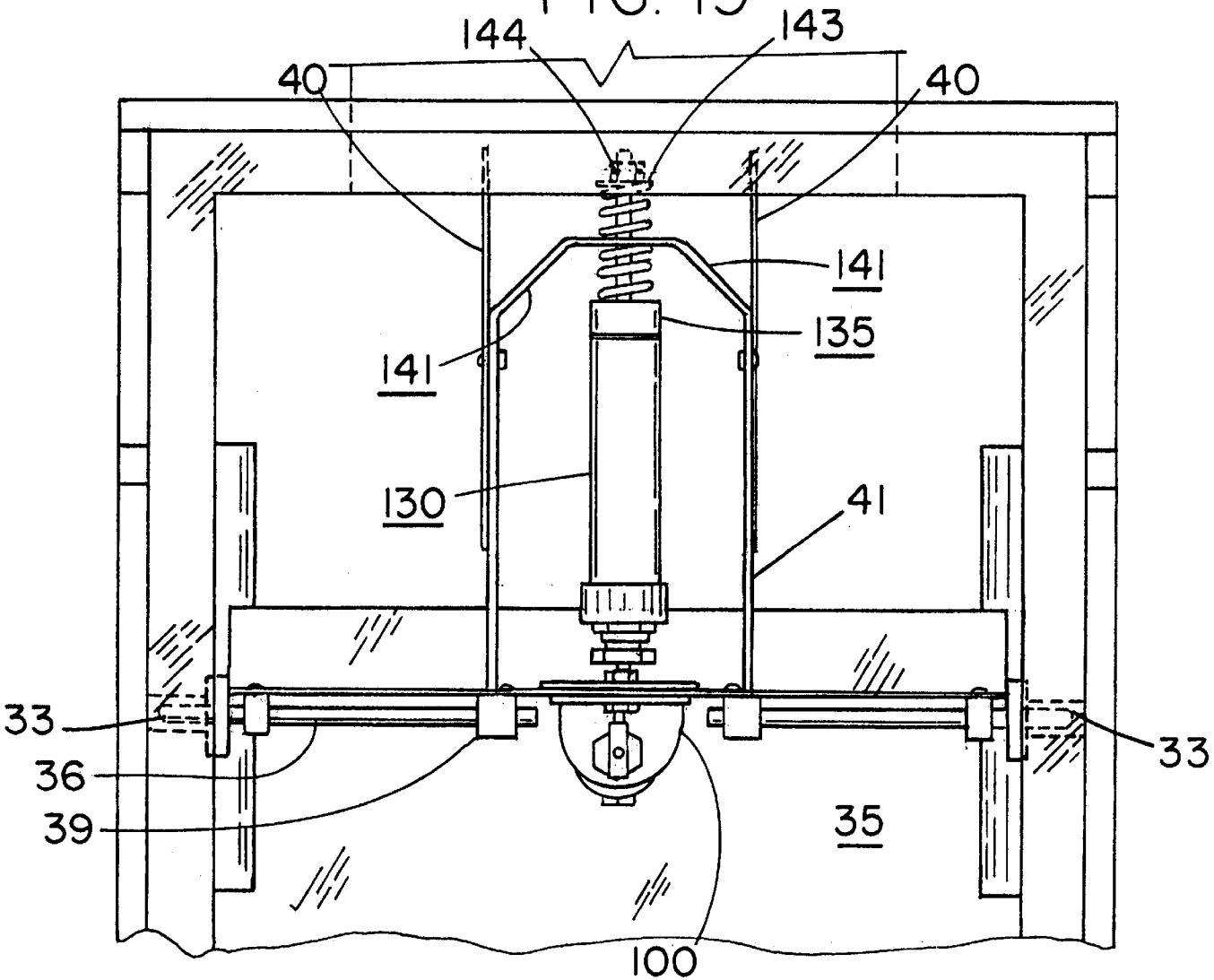
FIG. 19 is a schematic top view taken along line 19—19 of the present invention.
Figure 20:
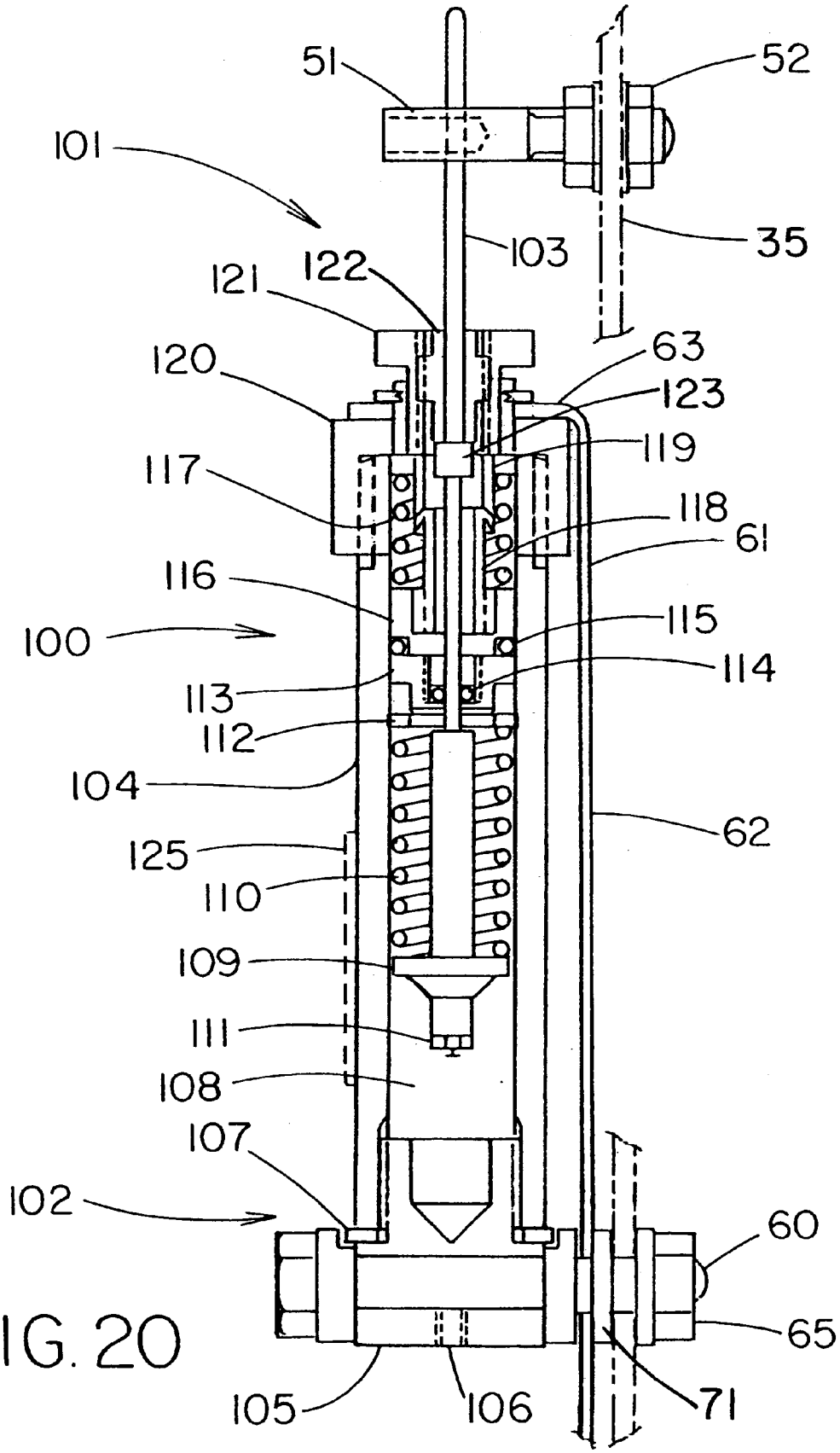
FIG. 20 is a schematic cross-sectional view of the thermally actuated devices of the present invention.
Figure 21:
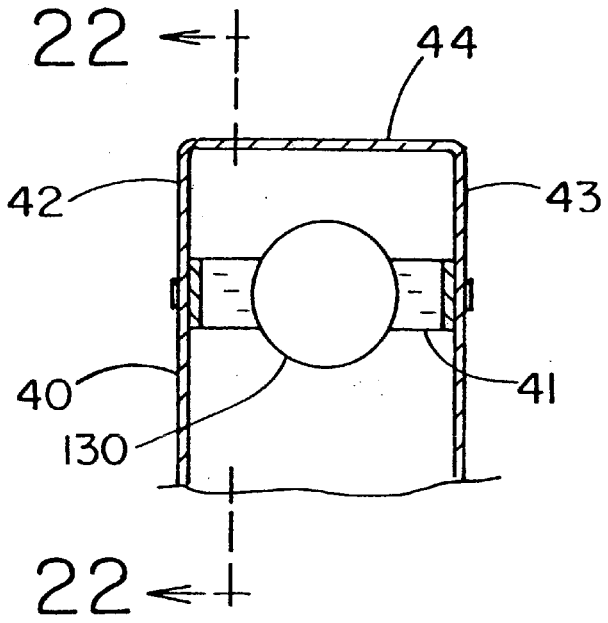
FIG. 21 is a schematic front view of the cowl and yolk of the present invention.
Figure 22:
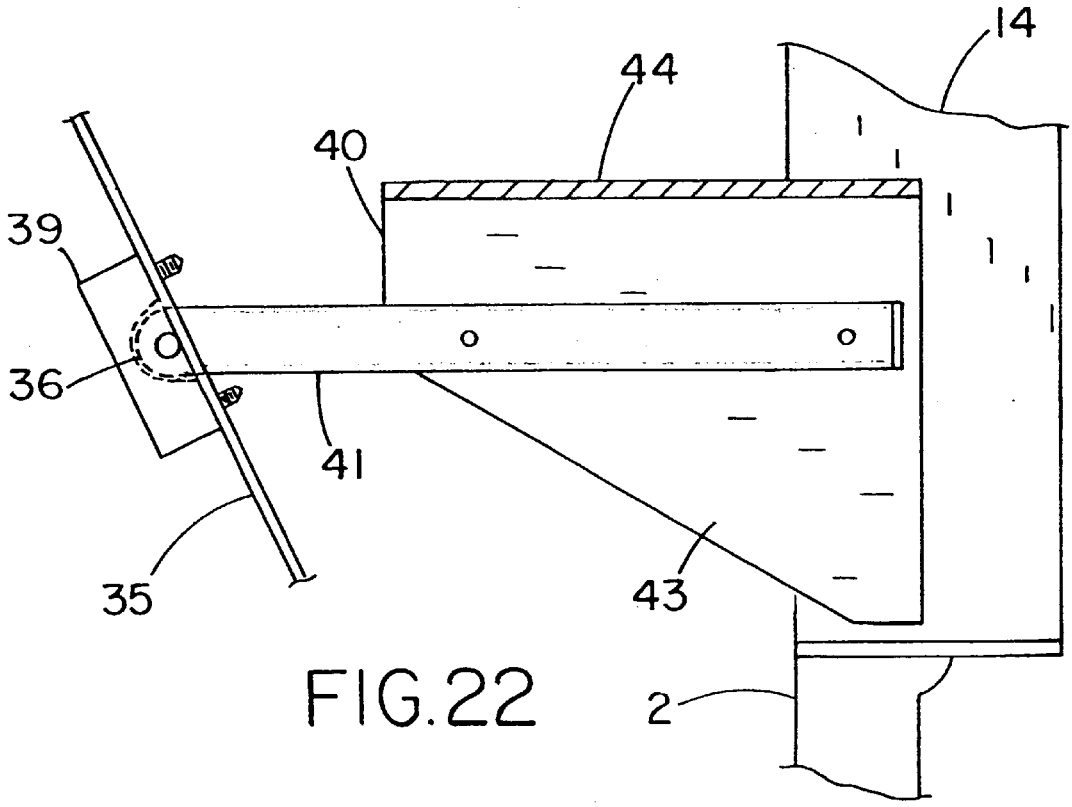
FIG. 22 is a schematic side view of the cowl and yolk of the present invention.

The second device has an end which is coupled to a yolk 41. The yolk allows the piston shaft 131 to move relative to the pivot shaft 36 while the second end 138 of the pin remains stationary. The yolk 41 and additional springs 139, 142 are employed with the second device to restrict pressure caused by the first device changing position while the second device is at either end of its stroke. FIG. 10 shows the hinge lower than the pivot shaft. The power of the wax expanding or contracting in the first device will force the second device to contract or expand as the hinge 70 moves relative to the pivot shaft 36. This will ensure that the hinge can move from the lower side of the pivot shaft to a point higher than the pivot shaft without becoming jammed at point either higher or lower than the pivot shaft.

The first device 100 in the warmed position urges the mounting apparatus away from the bracket such that the hinge is oriented on a first side, or lower side as in FIG. 10, of the pivot shaft. The first device in the cooled position urges the mounting apparatus toward the bracket such that the hinge is oriented on a second side, or high side as in FIG. 10, of the pivot shaft.

The second device 130, in the warmed position, urges its piston shaft 131 against the bracket assembly 60. In the cooled position, the piston shaft 131 of the second device pulls the bracket assembly 60.

There are four combinations of warmed and cold positions which rotate the blade. This allows the blade to rotate between fully open or closed positions or intermediate positions therebetween.

The warmed position of the first device 100 and second device 130 orients the blade damper 35 such that air flowing along the air path is directed toward the lid 17 and through the second duct opening 14.

The warmed position of the first device 100 and the cooled position of the second device 130 orients the blade such that the air flowing along the air path is directed toward the eyelash vents 30 in the grill 27.

The cooled position of the first device 100 and the warmed position of the second device 130 orients the blade such that air flowing along the air path is directed toward the eyelash vents 30 in the grill 27.

The cooled position of the first device 100 and the second device 130 orients the blade such that air flowing along the air path is directed toward the second opening 14.

FIGS. 12 through 16 best depict a second embodiment of the present invention. This embodiment functions nearly identical to the first. The primary difference between the two is that the second embodiment is made for only one duct. The first 100 and second 130 devices rotate the damper blade 35, all of which are within a duct opening 145. The damper blade is rotated to open and close the single duct opening 145. The second device is mounted to a fixed plate 146. The plate extends from the proximal corner of the lid to the center of the housing. At the center of the housing is a second pivot shaft 147. This pivot shaft has a second damper blade 148 rotatably coupled to the second pivot shaft 147. Attached to and extending away from the second damper blade is a weight 149.

In use, as air enters the single duct 145 of the second embodiment, the first device contracts or expands, causing the piston shaft of the second device to move in relation to the first pivot shaft 36. The second device 130 expands or contracts to the dictates of a room-mounted sensor, not shown, causing the damper blade to either allow air into the housing or closing the duct opening. The grill 150 for the second embodiment does not require a section of rectangular vents and only utilizes eyelash vents 151. Due to damper blade 35 angle, there may be a large or a small volume of air entering the housing. The second damper blade 148 is coupled to a weight 149 which biases it into a position adjacent to the single duct opening 145. As the first damper blade opens and the volume of air increases in the housing, and the second damper blade 148 is pushed away from the single duct opening. The weight keeps constant pressure against the air volume and ensures a constant air pressure to give a constant grill throw of air and circulate the air more effectively.

A third embodiment of the current invention utilizes electrical heating elements 125 placed on the outside of a single cylinder to control expansion and contraction of the wax. The elements would be operatively coupled to a thermostat which would be located on the housing in the air path or in the room being used. The heating elements could also be controlled from a central control either by remote control or standard methods. The second device 130 could also expand or contract due to a remote capillary was sensor (not shown).

A fourth embodiment, best depicted by FIGS. 5 and 8 of the current invention utilizes electric motors 126 that are coupled to the pivot shaft 36 which tilts the damper blade 35. Sensors 127 would detect air temperature in the first duct opening 13 and the temperature in the room to determine if the damper blade will allow air from the first duct opening through the third exit opening 16. This embodiment may also be operatively coupled to a thermostat or temperature sensor to manipulate blade rotation via a controller 127 positioned on the housing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A thermally actuated diffuser for regulating air flow from a duct into a space, said diffuser comprising:

a housing having a first duct opening for communicating with a first duct and a second duct opening for communicating with a second duct, said second duct opening being diametrically opposed to said first duct opening to produce a substantially linear air path through an interior of said housing from said first duct opening to said second duct opening, said housing having a third exit opening for communicating with a room wherein said third exit opening lies in a plane orientated substantially perpendicular to said first duct opening and said second duct opening;

a damper blade for diverting air flow from said air path, said damper blade being positioned in the interior of said housing, said damper blade having a first side and a second side such that said first side of said damper blade being generally facing the first duct opening and said second side of said damper blade being generally facing the second duct opening;

a first device wherein said first device is responsive to the ambient temperature around said first device;

a second device wherein said second device is responsive to the ambient temperature around said second device;

wherein said first and second devices each have a first end and a second end, wherein said first end and said second end are adapted to move away from each other when said device is warmed and said first end and said second end are adapted to move toward each other when said device is cooled, wherein said first and second ends are extended away from each other in a warmed position when thermal energy is applied and said first and second ends are retracted inwardly toward each other in cooled position when thermal energy is removed;

wherein said first device being positioned in the interior of said housing adjacent to said air path so as to be struck by air flowing along said air path, said second device being positioned in said housing adjacent to said third exit opening so as to be surrounded by air entering the interior of said housing through said third exit opening;

a bracket assembly adapted for coupling said first end of the first device to said first side of the damper blade, wherein a longitudinal axis of said first device is oriented substantially perpendicular to said air flow;

a mounting assembly adapted for mounting said first device to said second device, wherein said second device is adjacent to said second side of said damper blade, said second device having a longitudinal axis oriented substantially perpendicular to said longitudinal axis of said first device;

a hinge coupling said second device to said mounting assembly; and wherein said damper blade has openings therein adapted to allow said mounting assembly to be movable relative to said pivot shaft, wherein said mounting assembly being is movable between a warmed position and a cooled position of said first device.

2. The thermally actuated diffuser for regulating air flow form a duct into a space of claim 1, further comprising:

two box supports for supporting said housing within a wall, each of said box supports comprising an elongate U-shaped shaft, each of said box supports being adapted to fit on either edge of said housing wherein said edges are opposite edges of the housing on a side of the housing having said third exit opening, said edges of housing having two slots therein for receipt of said box supports.

3. The thermally actuated diffuser for regulating air flow from a duct into a space of claim 1, further comprising:

wherein said damper blade being positioned in the interior of said housing, said damper blade being positionable generally parallel to said first duct opening in said housing, said damper blade having a first and second side, wherein said first side of said damper blade generally faces said first duct opening, said damper blade being pivotally mounted in the interior of said housing for pivoting between a first position, wherein a portion of the air flow along the air path is diverted through said third exit opening and a second position, wherein the air flow along said air path is permitted to move along said air path without diversion of a significant amount of air flow through said third exit opening.

4. The thermally actuated diffuser for regulating air flow from a duct into a space of claim 1, wherein first and second devices further comprise:

a cylinder having a substantial hollow interior, said hollow interior being defined by an inner wall;

a plug adjacent to said second end of said device, said plug having bore therethrough;

a sealing washer adapted to prevent wax from moving past said sealing washer in the interior of said cylinder, said sealing washer being adjacent to said plug;

a wax fill cavity portion for holding said wax, said cavity defined by said inner wall of said cylinders, said plug and an inner shuttle nut;

a return spring having a first end adjacent to and biased against said spring base;

a piston shaft, said shaft extending away from said spring base through and out of the interior of said cylinder;

a shaft clip, said shaft clip retaining said return spring, said spring base and said piston shaft;

a stop washer, said stop washer being adjacent to and biased against a second end of said return spring;

a shaft 'O' ring being adjacent to said stop washer;

a shuttle 'O' ring being adjacent to said shaft 'O' ring;

a shuttle being adjacent to said shuttle 'O' ring;

said inner shuttle nut for retaining said shuttle 'O' ring and said shaft 'O' ring;

an over-pressure spring adjacent to and extending away from said shuttle wherein a compressor bottom and a compressor top are on either end of said over-pressure spring;

a cap is placed adjacent to said compressor top, said cap being outside of said cylinder of said first device; and a pressure adjuster means for adjusting movement of said shuttle is affixed to said cap with a lock nut with said piston shaft extending through a bore in said adjuster means and said cap;

wherein said second device further comprises:

a pin mounted in said bore in said plug, said pin extending outwardly away from said plug, said pin forming a spring mount having a first and a second end;

a first relief spring mounted on said spring mount, said spring resting against said plug;

a support bearing being located at an apex of said relief spring, said support bearing having two elongate members extending therefrom horizontally and diametrically from each other, said elongate members bending to become parallel to each other to define a piston yolk;

a second relief spring mounted on said spring mount, said second relief spring having a first end adjacent to said piston yoke;

a stop washer being affixed by a nut to said second end of said spring mount; and a quantity of wax, said wax being located in said wax fill cavities of each of said first and second devices, said wax being adapted to expand when subjected to additional thermal energy, said wax being adapted to contract when thermal energy is removed.

5. The thermally actuated diffuser for regulating air flow from a duct into a space of claim 1, wherein said housing having a removable lid, said lid having a proximal side and a distal side, wherein said proximal side of said lid is positioned adjacent to an edge of said first duct opening, said proximal side having a protuberance extending downward, said protuberance being generally triangular in shape, said protuberance having an apex with an edge extending therefrom.

6. The thermally actuated diffuser for regulating air flow from a duct into a space of claim 5, further comprising:

a grill for directing airflow inwardly and outwardly of said third exit opening, said grill having dimensions being adapted to fit across said side of said box having said third exit opening.

7. The thermally actuated diffuser for regulating air flow from a duct into a space of claim 6, further comprising:

wherein said grill having a proximal side and a distal side, said grill being oriented such that said proximal side of said grill is adjacent to an edge of said first duct opening in said housing, said proximal side of said grill having rotatable eyelash vents mounted thereon, said eyelash vents being oriented substantially perpendicular to said air path, said distal side of said grill having rectangular vents therein, said grill being fastened to said box supports by a fastener means; and wherein said second device being positioned between said distal end of said lid and said distal end of said grill.

8. The thermally actuated diffuser for regulating air flow from a duct into a space of claim 1, further comprising:

wherein said housing having opposing walls positioned on either side of said air path;

a pivot shaft mounted to said damper blade for permitting rotation of said damper blade, said pivot shaft being mounted in said housing, wherein the pivot shaft has opposite mounting ends, each of said mounting ends being mounted to said opposing walls of said housing, said pivot shaft being oriented substantially perpendicular to said air path between said first duct opening and said second duct opening, said pivot shaft being comprised of two separate elongate portions with an open expanse therebetween, each elongate portion having an interior end spaced from an interior end of the other elongate portion, the interior end of each elongate portion being coupled to said damper blade, said pivot shaft being adapted to allow said damper blade to rotate in said air path; and wherein said first device being mounted between said spaced interior ends of said pivot shaft.

9. The thermally actuated diffuser for regulating air flow from a duct into a space of claim 8, further comprising:

two hole caps for mounting a yolk, each of said hole caps being mounted on one of said spaced ends of said pivot shaft, said yolk having two elongate members, wherein each of said elongate members is coupled to one of said caps, said elongate members extending outwardly from said hole caps generally parallel to each other in the direction of said second duct opening of said box, said elongate members extending adjacent to said second duct opening, said members each turning at substantially right angles toward each other such that said members join at a location on said second device.

10. The thermally actuated diffuser for regulating air flow from a duct into a space of claim 9, further comprising:

wherein each of said first ends of said first and second devices including a piston shaft and each of said second ends of said first and second devices including a cylinder having said piston shaft slidably received therein;

wherein said bracket assembly being coupled to said piston shaft of said first device; and wherein said second device being adjacent to said second side of said damper blade such that said damper blade is between said first device and said second device.

11. The thermally actuated diffuser for regulating air flow from a duct into a space of claim 10, wherein said mounting assembly further comprises:

a first plate adjacent to said first device, said first plate being longer than said cylinder of said first device, said first plate having a L-shape, wherein a short end of said L-shaped plate is affixed to an end of said cylinder adjacent to said piston shaft of said first device and wherein a long end of said first L-shaped plate is parallel to said first device, said first plate being located between said first device and a first side of said blade damper;

a second plate located between said second device and the second side of said blade damper, said second plate being oriented substantially parallel to said first plate;

a first coupling means for coupling said first plate to said second plate, wherein said first coupling means is mounted to said second end of first device, said first coupling means being orientated perpendicular to said first plate, said first coupling means extending through a bore in said first plate and a bore in said second plate;

a second coupling means for coupling said first plate to said second plate, said second coupling means being substantially located at the intersection of a longitudinal axis line of said second device and said second plate, said second coupling means being generally rectangular with a bolt extending through each corner thereof, each of said bolts being secured by a nut; and wherein said hinge coupling being substantially centered on said second coupling means, said hinge being fixedly coupled to said first plate between said first plate and said first device, said hinge being coupled to said piston shaft of said second device, wherein said piston shaft of said second device extends through a bore in said first plate and a bore in said second plate.

12. The thermally actuated diffuser for regulating air flow from a duct into a space of claim 9, wherein said cylinder of said first and second devices further comprise:

said cylinder having a substantially hollow interior, said hollow interior being defined by an inner wall;

a plug adjacent to said second end of said device, said plug having bore therethrough;

a sealing washer adapted to prevent a wax from moving past said sealing washer in the interior of said cylinder, said sealing washer being adjacent to said plug;

a wax fill cavity portion for holding said wax, said cavity defined by said inner wall of said cylinders, said plug and a spring base;

a stop washer;

a return spring having a second end adjacent to and biased against said stop washer;

said piston shaft extending away from said spring base through and out of the interior of said cylinder;

a shaft clip, said shaft clip retaining said return spring, said spring base and said piston shaft;

said spring base being adjacent to and biased against a first end of said return spring;

an inner shuttle nut being adjacent to said stop washer;

a shaft 'O' ring being adjacent to said inner shuttle;

a shuttle 'O' ring being adjacent to said shaft 'O' ring;

a shuttle being adjacent to said shuttle 'O' ring;

an over-pressure spring adjacent to and extending away from said shuttle wherein a compressor bottom and a compressor top are on either end of said overpressure spring;

a cap is placed adjacent to said compressor top, said cap being outside of said cylinder of said first device; and a pressure adjuster means for adjusting movement of said shuttle is affixed to said cap with a lock nut with said piston shaft extending through a bore in said adjuster means and said cap;

wherein said second device further comprises:

a pin mounted in said bore in said plug, said pin extending outwardly away from said plug, said pin forming a spring mount having a first and a second end;

a first relief spring mounted on said spring mount, said spring resting against said plug;

a support bearing being located at an apex of said relief spring, said support bearing being coupled to said two elongate members of said yolk, said elongated members extending from said support bearing generally horizontally and diametrically from each other, said elongate members bending to become parallel to each other and extending toward said hole caps;

a second relief spring mounted on said spring mount, said second relief spring having a first end adjacent to said piston yoke;

a stop washer being affixed by a nut to said second end of said spring mount, a cowl for supporting said second device, said cowl having a first side portion, a second side portion, and a top portion, said first side portion being coupled to one of said elongate members of said yolk, said second side portion being coupled to the other of said elongate members of said yolk;

a quantity of wax, said wax being located in said wax fill cavities of each of said first and second devices, said wax being adapted to expand when subjected to additional thermal energy, said wax being adapted to contract when thermal energy is removed.

13. A thermally actuated diffuser for regulating air flow from a duct into a space, said diffuser comprising:

a housing having at least one duct opening for communicating with a duct, said housing having an exit opening for communicating with a room wherein said third exit opening lies in a plane oriented substantially perpendicular to said first duct opening, said duct defining an airflow oriented substantially parallel to said exit opening;

a damper blade for diverting air flow from said air path, said damper blade being positioned in the interior of said housing, said damper blade having a first side and a second side such that said first side of said damper blade being generally facing the duct opening;

a first device wherein said first device is responsive to the ambient temperature around said first device, said first device being mounted adjacent to said first side of said damper blade;

a second device wherein said second device is responsive to the ambient temperature around said second device;

wherein said first and second devices each have a first end and a second end, wherein said first end and said second end are adapted to move away from each other when said device is warmed and said first end and said second end are adapted to move toward each other when said device is cooled, wherein said first and second ends are extended away from each other in a warmed position when thermal energy is applied and said first and second ends are retracted inwardly toward each other in cooled position when thermal energy is removed;

wherein said first device being positioned in the interior of said housing adjacent to an air path so as to be struck by air flowing along said air path, said second device being positioned in said housing between said exit opening and a wall in said housing diametrically opposed to said exit opening so as to be surrounded by air entering the interior of said housing through said exit opening;

a bracket assembly adapted for coupling said first end of the first device to said first side of the damper blade, wherein a longitudinal axis of said first device is oriented substantially perpendicular to said air flow;

a mounting assembly adapted for mounting said first device to said second device, wherein said second device is adjacent to said second side of said damper blade, said second device having a longitudinal axis oriented substantially perpendicular to said longitudinal axis of said first device;

a hinge coupling said second device to said mounting assembly;

wherein said damper blade has openings therein adapted to allow said mounting assembly to be movable relative to said pivot shaft, wherein said mounting assembly being is movable between a warmed position and a cooled position of said first device;

wherein said first and second devices further comprises:

a cylinder having a substantial hollow interior, said hollow interior being defined by an inner wall;

a plug adjacent to said second end of said device, said plug having bore therethrough;

a sealing washer adapted to prevent wax from moving past said sealing washer in the interior of said cylinder, said sealing washer being adjacent to said plug;

a wax fill cavity portion for holding said wax, said cavity defined by said inner wall of said cylinders, said plug and an inner shuttle nut;

a return spring having a first end adjacent to and biased against said spring base;

a piston shaft, said shaft extending away from said spring base through and out of the interior of said cylinder;

a shaft clip, said shaft clip retaining said return spring, said spring base and said piston shaft;

a stop washer, said stop washer being adjacent to and biased against a second end of said return spring;

a shaft 'O' ring being adjacent to said inner stop washer;

a shuttle 'O' ring being adjacent to said shaft 'O' ring;

a shuttle being adjacent to said shuttle 'O' ring;

said inner shuttle nut for biasing said stop washer against said shaft 'O' rind and said shuttle 'O' ring;

an over-pressure spring adjacent to and extending away from said shuttle wherein a compressor bottom and a compressor top are on either end of said over-pressure spring;

a cap is placed adjacent to said compressor top, said cap being outside of said cylinder of said first device; and a pressure adjuster means for adjusting movement of said shuttle is affixed to said cap with a lock nut with said piston shaft extending through a bore in said adjuster means and said cap;

wherein said second device further comprises:

a pin mounted in said bore in said plug, said pin extending outwardly away from said plug, said pin forming a spring mount having a first and a second end;

a first relief spring mounted on said spring mount, said spring resting against said plug;

a support bearing being located at an apex of said relief spring, said support bearing having two elongate members extending therefrom horizontally and diametrically from each other, said elongate members bending to become parallel to each other to define a piston yolk;

a second relief spring mounted on said spring mount, said second relief spring having a first end adjacent to said piston yoke;

a stop washer being affixed by a nut to said second end of said spring mount; and a quantity of wax, said wax being located in said wax fill cavities of each of said first and second devices, said wax being adapted to expand when subjected to additional thermal energy, said wax being adapted to contract when thermal energy is removed.

14. The thermally actuated diffuser for regulating air flow from a duct into a space of claim 13 further including:

a heating element for controlling expansion and contraction of said wax, said heating element being coupled to an outside of said cylinder adjacent to said wax cavity; and a thermostat operatively coupled to said heating element.

15. The thermally actuated diffuser for regulating air flow from a duct into a space of claim 13 further including:

a heating element for controlling expansion and contraction of said wax, said heating element being coupled to an inside of said cylinder adjacent to said wax cavity; and a thermostat operatively coupled to said heating element.

16. A thermally actuated diffuser for regulating air flow from a duct into a space, said diffuser comprising:

a housing having a first duct for communicating with a first duct opening and a second duct opening for communicating with a second duct, said second duct opening being diametrically opposed to said first duct opening to produce a substantially linear air path through said housing from said first duct opening to said second duct opening, said first and second ducts each lying in a plane substantially parallel to the plane of the other said duct opening, said housing having opposing walls positioned on either side of said air path, said housing having a third exit opening for communicating with a room, wherein said third exit opening lies in a plane orientated substantially perpendicular to said first duct opening and said second duct opening;

a removable lid on said housing, said lid having a proximal side and a distal side, wherein said proximal side of said lid is positioned adjacent to an edge of said first duct opening, said proximal side having a protuberance extending toward said third exit opening, said protuberance being generally triangular in shape, said protuberance having an apex with an edge extending therefrom;

two box supports for supporting said housing within a wall, each of said box supports comprising an elongate U-shaped shaft, wherein said housing has opposite edges on a side of the housing having said third exit opening, each of said box supports being adapted to mount on one of said edges of said housing, said edges of said housing having two slots therein for receiving said box supports;

a grill for directing airflow inwardly and outwardly of said third exit opening, said grill having dimensions being adapted to fit across said side of said box having said third exit opening, said grill having a proximal side and a distal side, said grill being oriented such that said proximal side of said grill is adjacent to an edge of said first duct opening in said housing, said proximal side of said grill having rotatable eyelash vents mounted thereon, said eyelash vents being oriented substantially perpendicular to said air path, said distal side of said grill having rectangular vents therein, said grill being fastened to said box supports by a fastener means;

a damper blade for diverting air flow from said air path, said damper blade being positioned in the interior of said housing, said damper blade being positionable generally parallel to said first duct opening in said housing, said damper blade having a first and second side, wherein said first side of said damper blade generally faces said first duct opening, said damper blade being pivotally mounted in the interior of said housing for pivoting between a first position wherein a portion of the air flow along the air path is diverted through said third exit opening and a second position wherein the air flow along said air path is permitted to move along said air path without diversion of a significant amount of air flow through said third exit opening;

a pivot shaft mounted to said damper blade for permitting rotation of said damper blade, said pivot shaft being mounted in said housing, wherein the pivot shaft has opposite mounting ends, each of said mounting ends being mounted to one of said opposing walls of said housing, said pivot shaft being oriented substantially perpendicular to said air path between said first duct opening and said second duct opening, said pivot shaft being comprised of two separate elongate portions with an open expanse therebetween, each elongate portion having an interior end spaced from an interior end of the other elongate portion, the interior end of each elongate portion being coupled to said damper blade, said pivot shaft being adapted to allow said damper blade to rotate in said air path;

two hole caps for mounting a yolk, each of said hole caps being mounted on one of said spaced interior ends of said pivot shaft, said yolk having two elongate members, wherein each of said elongate members is coupled to one of said caps and coupled to said spaced interior ends of said pivot shafts in said hole caps, said elongate members extending outwardly from said hole caps parallel to each other in the direction of said second duct opening of said box, said elongate members extending toward said second duct opening, said elongate members each turning at substantially right angles toward each other such that said elongate members touch and fluidly join;

a first device wherein said first device is responsive to the ambient temperature around said first device;

a second device wherein said second device is responsive to the ambient temperature around said second device;

wherein said first and second devices are generally elongate and each of the devices has a first end and a second end, wherein said first end and said second end are adapted to move away from each other when said device is warmed and said first end and said second end are adapted to move toward each other when said device is cooled, wherein said first and second ends are relatively extended away from each other in a warmed position and said first and second ends are relatively retracted inwardly toward each other in a cooled position, each of said first ends including a piston shaft and each of said second ends including a cylinder having said piston shaft slidably received therein, wherein said first device is positioned in the interior of said housing adjacent to said air path so as to be surrounded by air flowing along said air path;

a bracket assembly for coupling the first end of said first device to said damper blade, a first portion of said bracket assembly being coupled to said piston shaft of said first device, a second portion of said bracket being coupled to said damper blade such that a longitudinal axis of said first device is substantially perpendicular to said air flow, said first device being positioned between said spaced ends of said pivot shaft;

a mounting assembly for mounting said first device to said second device, wherein said first and said second devices are located on opposite sides of said damper blade and wherein said second device has a longitudinal axis oriented substantially perpendicular to said longitudinal axis of said first device, wherein said second device is positioned between said distal side of said lid and said distal side of said grill so as to be surrounded by air entering the interior of said housing through said third exit opening, wherein said mounting assembly comprises:

a first plate adjacent to said first device, said first plate being longer than said cylinder of said first device, said first plate having a L-shape with a long end and a short end, wherein the short end of said L-shaped plate is affixed to an end of said cylinder adjacent to said piston shaft of said first device and wherein the long end of said first L-shaped plate is parallel to said first device, said first plate being located between said first device and a first side of said blade;

a second plate located between said second device and a second side of said blade, said second plate being oriented substantially parallel to said first plate;

a first coupling means for coupling said first plate to said second plate, wherein said first coupling means is mounted to said first end of said first device, said first coupling means being orientated perpendicular to said first plate, said first coupling means extending through a bore in said first plate and a bore in said second plate;

a second coupling means for coupling said first plate to said second plate, said second coupling means being located substantially at the intersection of a longitudinal line of said second device and said second plate, said second coupling means being generally rectangular with a bolt extending through each corner thereof, each of said bolts being secured by a nut;

a hinge coupling said second device to said mounting assembly, said hinge being substantially centered on said second coupling means, said hinge being fixedly coupled to said first plate between said first plate and said first device, said hinge being coupled to said piston shaft of said second device, wherein said piston shaft of said second device extends through a bore in said first plate and a bore in said second plate;

wherein said damper blade has openings therein adapted to allow said first plate to be connected to said second plate such that said mounting assembly is movable relative to said pivot shaft, wherein said mounting assembly is movable between a warmed position and a cooled position of said first device;

wherein said first device in said warmed position urges said mounting apparatus away from said bracket such that said hinge is oriented on a first side of said pivot shaft, and wherein said first device in said cooled position urges said mounting apparatus toward said bracket such that said hinge is oriented on a second side of said pivot shaft;

wherein the warmed position of said first device and second device orients said blade damper such that air flowing along said air path is directed toward said lid and through said second duct opening;

wherein the warmed position of said first device and the cooled position of said second device being orients said blade such that the air flowing along said air path is directed toward said eyelash vents in said grill;

wherein the cooled position of said first device and the warmed position of said second device orients said blade such that air flowing along said air path is directed toward said eyelash vents in said grill;

wherein the cooled position of said first device and said second device orients said blade such that air flowing along said air path is directed toward said second opening;

wherein said cylinder of said first and second devices having a substantially hollow interior, said hollow interior being defined by an inner wall, wherein said cylinder of said first and second devices further comprise:

a plug adjacent to said second end of said device, said plug having bore therethrough;

a sealing washer adapted to prevent wax from moving past said sealing washer in the interior of said cylinder, said sealing washer being adjacent to said plug;

a wax fill cavity portion for holding said wax, said cavity defined by said inner wall of said cylinders, said plug and an inner shuttle nut;

a return spring having a first end adjacent to and biased against said spring base;

a piston shaft, said shaft extending away from said spring base through and out of the interior of said cylinder;

a shaft clip, said shaft clip retaining said return spring, said spring base and said piston shaft;

a stop washer, said stop washer being adjacent to and biased against a second end of said return spring;

a shaft 'O' ring being adjacent to said stop washer;

a shuttle 'O' ring being adjacent to said shaft 'O' ring;

said inner shuttle nut for biasing against said shaft 'O' ring and shuttle 'O' ring;

a shuttle being adjacent to said shuttle 'O' ring;

an over-pressure spring adjacent to and extending away from said shuttle wherein a compressor bottom and a compressor top are on either end of said over-pressure spring;

a cap is placed adjacent to said compressor top, said cap being outside of said cylinder of said first device; and a pressure adjuster means for adjusting movement of said shuttle is affixed to said cap with a lock nut with said piston shaft extending through a bore in said adjuster means and said cap;

wherein said second device further comprises:

a plug, said plug being hollow and having a bore therethrough, said bore being on a top side of said plug, said plug being adjacent to said plug;

a pin mounted in said bore in said plug, said pin extending outwardly away from said plug, said pin forming a spring mount having a first and a second end;

a first relief spring mounted on said spring mount, said spring resting against said plug;

a support bearing being located at an apex of said relief spring, said support bearing being coupled to said two elongate members of said yolk;

a cowl for supporting said second device, said cowl having a first side portion, a second side portion, and a top portion, said first side portion being coupled to one of said elongate members of said yolk, said second side portion being coupled to the other of said elongate members of said yolk;

a second relief spring mounted on said spring mount, said second relief spring having a first end adjacent to said piston yoke;

a stop washer being affixed by a nut to said second end of said spring mount; and a quantity of wax, said wax being located in said wax fill cavities of each of said first and second devices, said wax being adapted to expand when subjected to additional thermal energy, said wax being adapted to contract when thermal energy is removed.

* * * * *